US007234396B2

(12) United States Patent
Kleinschnitz et al.

(10) Patent No.: US 7,234,396 B2
(45) Date of Patent: Jun. 26, 2007

(54) INK APPLICATOR HAVING MOVABLE BAR AND BLADE FOR OPENING AND CLOSING INK GAP

(75) Inventors: Josef Karl Kleinschnitz, Greussenheim (DE); Thomas Kubert, Karlburg (DE)

(73) Assignee: KBA-Metronic AG, Veitshochheim (DE)

( * ) Notice: Subject to any disclaimer, the term of this patent is extended or adjusted under 35 U.S.C. 154(b) by 105 days.

(21) Appl. No.: 10/939,323

(22) Filed: Sep. 10, 2004

(65) Prior Publication Data

US 2005/0081729 A1 Apr. 21, 2005

(30) Foreign Application Priority Data

Sep. 12, 2003 (DE) ..... 103 42 519
Oct. 17, 2003 (DE) ..... 103 49 053

(51) Int. Cl.
*B41F 31/04* (2006.01)

(52) U.S. Cl. ..... 101/350.6; 101/363; 101/350.1; 101/157

(58) Field of Classification Search ..... 101/350.6, 101/157, 169, 364, 366, 363, 349.1, 350.1; 118/413

See application file for complete search history.

(56) References Cited

U.S. PATENT DOCUMENTS 2,371,223 A * 3/1945 Crafts ..... 101/157
2,783,709 A * 3/1957 Thomas ..... 101/123
4,009,657 A * 3/1977 Bonanno et al. ..... 101/157
4,512,254 A * 4/1985 Reslow et al. ..... 101/157
5,287,806 A * 2/1994 Nanzai ..... 101/123
5,400,710 A * 3/1995 Ehrhard ..... 101/363
5,640,907 A * 6/1997 Tani et al. ..... 101/366
5,656,083 A * 8/1997 Schonberger ..... 118/107
6,053,102 A 4/2000 Schonberger
2003/0051619 A1* 3/2003 Rogge ..... 101/350.6

FOREIGN PATENT DOCUMENTS

| | | |
|---|---|---|
| DE | 294500 | 9/1915 |
| DE | 10028479 | 12/2001 |
| EP | 0022912 | 1/1981 |
| EP | 0955164 | 11/1999 |
| EP | 1090756 | 4/2001 |
| GB | 1590928 | 6/1981 |
| WO | WO-02/16137 | 2/2002 |

* cited by examiner

*Primary Examiner*—Leslie J. Evanisko
(74) *Attorney, Agent, or Firm*—Andrew Wilford

(57) ABSTRACT

An ink applicator has at least one generally stationary mounting part, a fixed elongated bar fixedly mounted on the mounting part and carrying an elongated applicator blade, and a movable elongated bar mounted on the mounting part, extending parallel to the fixed bar, carrying an elongated applicator blade parallel to the fixed-bar blade, and defining an elongated ink-holding compartment with the fixed bar. The movable bar is supported on the mounting part for movement between an outer position with the movable-bar blade spaced transversely from the fixed-bar blade and defining a gap through which ink can flow out of the compartment and an inner position with the blades engaging one another and closing the gap so that no ink can flow out of the compartment.

12 Claims, 2 Drawing Sheets

INK APPLICATOR HAVING MOVABLE BAR AND BLADE FOR OPENING AND CLOSING INK GAP

FIELD OF THE INVENTION

The present invention relates to an ink applicator. More particularly this invention concerns a device which applies a coating of ink or a similar liquid to a ink-transfer roller.

BACKGROUND OF THE INVENTION

A standard ink applicator for a printing machine or the like has an ink applicator that normally sits atop a transfer roll. The applicator forms a thin uniform coat of ink on the transfer roll which is then applied to the actual printing roll.

Such an applicator typically includes a pair of end parts that are spaced longitudinally apart and a pair of bars extending longitudinally parallel to each other between the end parts and each carrying a flexible applicator blade. The end parts, bars, and blades form a compartment that is open downward through a gap defined between confronting but spaced free edges of the blades. In use these blades ride lightly on the surface of the transfer roll and so that ink in the compartment can flow onto the transfer roll, being doctored into a thin layer by the trailing blade.

While such an arrangement works very well, when the applicator has to be changed, for instance because it needs servicing or different ink or tint is to be applied, it is standard practice to run the applicator dry. Once it is empty, it can be lifted off the transfer roll and switch for a new one that is then filled and used.

If the applicator is lifted off the transfer roll while still full there is usually a mess. Even though the ink is typically quite viscous, it can still flow out the bottom of the applicator, normally fouling the machine. This procedure is not normally preferred; instead it is better to shut off the ink supply and run the printer, thereby wasting ink and paper, until the applicator is empty.

OBJECTS OF THE INVENTION

It is therefore an object of the present invention to provide an improved ink applicator.

Another object is the provision of such an improved ink applicator which overcomes the above-given disadvantages, that is which can be easily switched, even when full, without making a mess or losing any significant quantity of ink.

SUMMARY OF THE INVENTION

An ink applicator has according to the invention at least one generally stationary mounting part, a fixed elongated bar fixedly mounted on the mounting part and carrying an elongated applicator blade, and a movable elongated bar mounted on the mounting part, extending parallel to the fixed bar, carrying an elongated applicator blade parallel to the fixed-bar blade, and defining an elongated ink-holding compartment with the fixed bar. The movable bar is supported on the mounting part for movement between an outer position with the movable-bar blade spaced transversely from the fixed-bar blade and defining a gap through which ink can flow out of the compartment and an inner position with the blades engaging one another and closing the gap so that no ink can flow out of the compartment.

Thus it is possible to close the gap in the ink applicator before it is lifted off the transfer roller. This makes it possible to switch out the ink applicator at virtually any time, even when full, without wasting ink or paper. What is more, the reverse process of putting a closed but full applicator into the press and then opening its gap while the blades are in contact with the transfer roll is also extremely efficient. No longer are there unneeded print runs for depleting ink or getting the ink started.

The movement of the movable bar can be a translatory movement or a pivotal movement. Normally according to the invention guide formations constrain the movable bar and its blade to translatory movement transversely relative to the fixed bar between its inner and outer positions. The translatory movement is preferably along an arc corresponding to the radius of curvature of the transfer roll so that the movable-bar blade edge remains in light but sealing contact with the transfer-roll surface during closing (and opening). When the movable bar is pivotal, its pivot axis is offset from the free edge of the movable-bar blade so that this edge moves along an arc during the pivoting. In fact both bars could be pivoted to move together and apart. In any case mechanism is provided to keep the blade edges in contact with the transfer-roll surface as the applicator is being moved from the open to the closed position.

The guide formations include an axially projecting pin and a transversely elongated slot in which the pin can slide. The slot is formed in the end part and the pin is fixed in the movable bar. More particularly, normally there are two such end parts at longitudinally opposite ends of the fixed bar and each of the end parts is formed with one such slot and the movable bar is provided with two such pins riding in the slots. In fact two or more such pins riding in respective slots can be provided on each end of the movable bar to ensure perfectly controlled translatory movement.

The ink applicator according to the invention is further provided with a seal engaging both blades at the end part and preventing leakage from the compartment out the gap adjacent the end part in both positions of the movable bar. This seal has a lip bearing on back faces of both blades.

The ink applicator further comprises a latch for locking the movable bar releasably in each of its positions. This latch includes a longitudinally retractile pin and a stop plate having a pair of holes in each of which the pin is engageable in a respective one of the positions of the movable bar. The latch pin is on the movable bar and the stop plate is on the end part. Similarly, there are two such end parts at longitudinally opposite ends of the fixed bar and each of the end parts is provided with one such stop plate and the movable bar is provided with two such pins.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
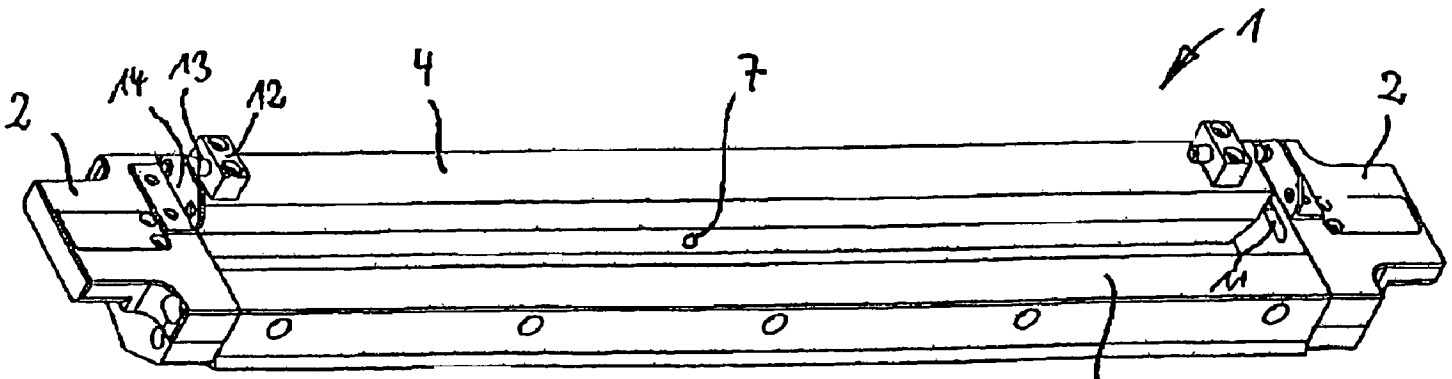
FIG. 1 is a perspective view of the ink applicator according to the invention.
Figure 2:
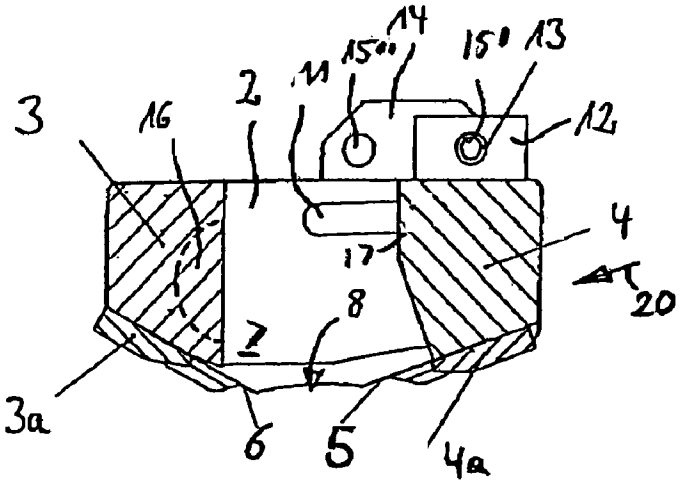
FIGS. 2 and 3 are cross sections through end and central regions of the applicator.
Figure 3:
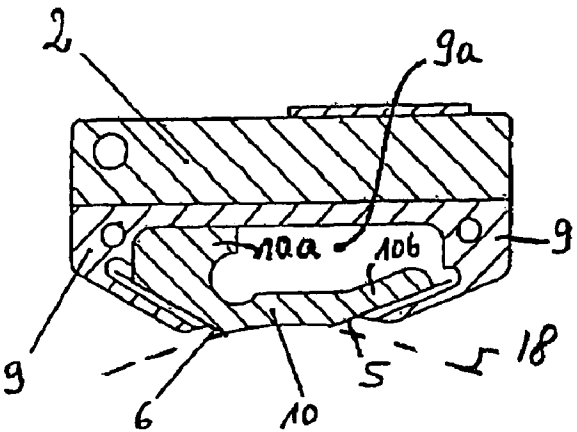
Figure 4:
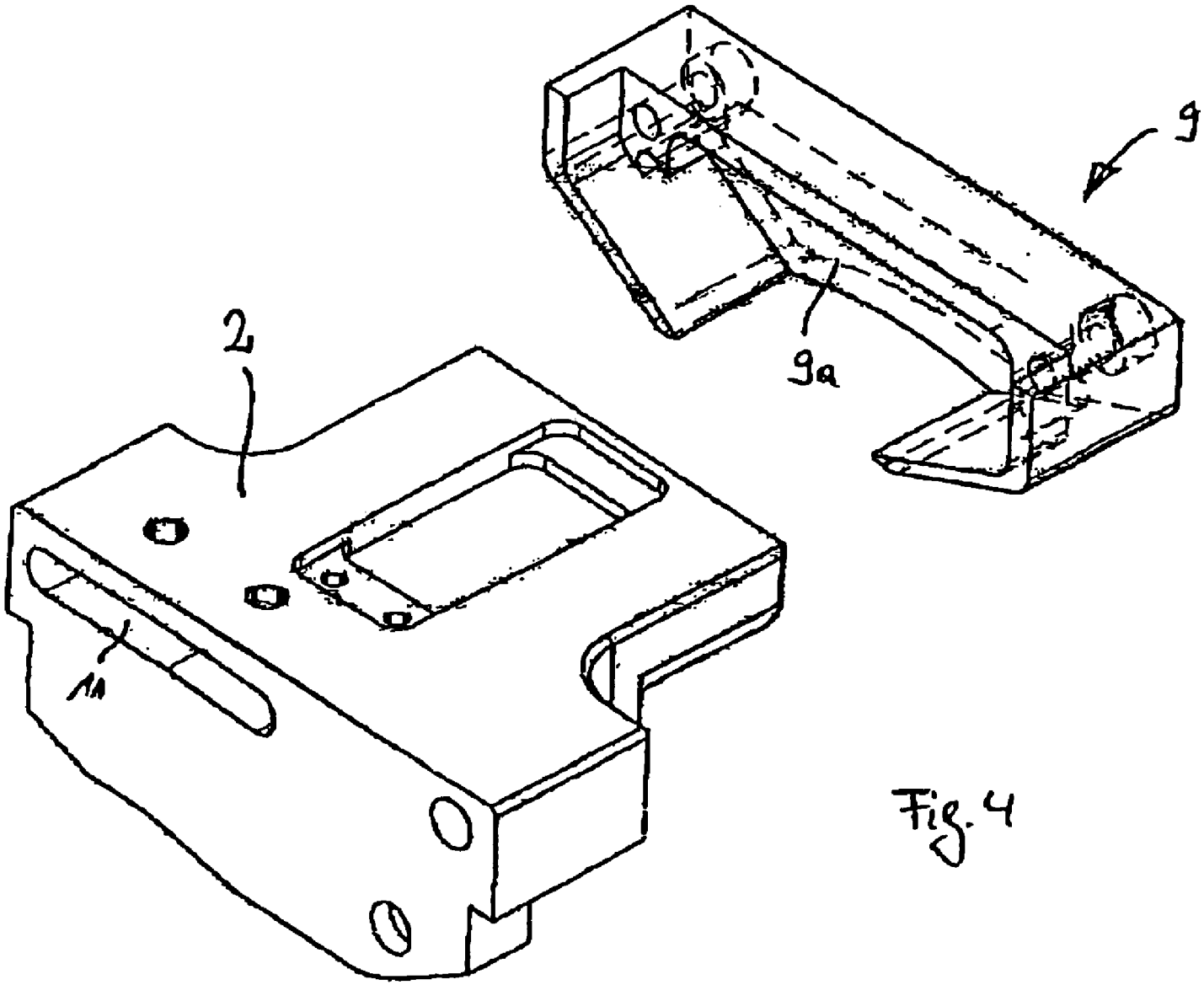
FIG. 4 is an exploded view of one of the end parts of the applicator.

As seen in FIGS. 1, 2, and 3, an ink applicator 1 is basically comprised of two symmetrically identical end parts 2 and two longitudinally extending and parallel bars 3 and 4. The bar 3 is fixed to both of the end parts 2 and forms a rigid, integral structure therewith. The two bars 3 and 4 carry respective flexible applicator blades 6 and 5, held in place by respective retaining bars 3*a* and 4*a*, and each normally formed by a thin sheet of stainless steel or the like. The bars 3 and 4 furthermore define an ink-holding compartment 7 and confronting edges of the blades 5 and 6 define a gap 8 through which ink can move from this compartment 7 for application to a transfer roll shown schematically at 18 in FIG. 3. Each end part 2 has an end cap 9 that has a face 9*a* closing the ends of the compartment 7 and a seal 10 that has a back part 10*a* bearing on the end part 2 and a lip 10*b* bearing on the backs or inner faces of the two blades 5 and 6 to close the gap 8 at the ends of the compartment 7, longitudinally past where ink is to be coated onto the roll 18.

According to the invention as mentioned above, the bar 3 and its blade 6 are fixed to the end parts 2. The bar 4, however, is provided at its ends with pins 17 that ride in respective slightly arcuate transverse grooves 11 in the end parts 2. Thus the bar 4 and its blade 5 can move transversely toward and away from the bar 3 and blade 6 as will be described below. In addition a latch assembly 12 on each end of the bar 4 has a longitudinally spring-loaded and displaceable pin 13 that can fit in either of two holes 15' and 15" of a stop plate 14 fixed on the respective end part 2. When the pins 13 are engaged in the outer holes 15' (to the right in FIG. 2), the confronting edges of the blades 5 and 6 are spaced apart and ink can exit the compartment 7 through the gap 8, but when the pins 13 are in the inner holes 15", the edge of the blade 15 sits against the upper inner face of the blade 6 somewhat inward of its edge and the gap 8 is closed. During this closing operation, the blade 5 will not only slide on the surface of the roll 18, but the tongue 10*b* of the seal 10 will slide on the back of this blade, preventing any leakage at the ends also.

During normal use, when the end parts 2 are fitted to a machine having the transfer roll 18, the pins 13 are engaged in the outer holes 15' so that the gap 8 is open and ink or the like can move from the compartment 7 through the gap 8 onto the surface of the transfer roller 18. For a change in ink, the machine operator retracts the pins 13 and presses the bar 4 transversely toward the bar 3. The pins 11 slide along the grooves 11, which have the same radius of curvature as the outer surface of the roller 18 so that the edge of the blade 5 will rest is light contact with it during this movement. The edge of the blade 5 will come to rest on the upper or back face of the blade 6 about when the pins 13 snap back out to engage in the holes 15", at which time the gap 8 is effectively closed and the entire applicator 1 can be lifted off the roller 18 and replaced with another. Engagement of the pins 13 in the holes 15" holds the applicator 1 closed. The ink in the compartment 7 can shift into the pocket 16 so that, even if the applicator gap 8 is closed when the compartment is relatively full, ink will not be forced back up and out the top of the applicator 1. Both bars 3 and 4 can be formed with such pockets 16.

It is of course within the scope of the invention to provide a motor or other actuator, e.g. a small pneumatic cylinder, to shift the movable blade bar 4 transversely between its end positions. Furthermore it would be possible for the movable bar 4 to move by pivoting, rather than the described translatory movement.

We claim:

1. In combination with a transfer roll having a cylindrical surface, an ink applicator comprising:

at least one generally stationary mounting part;

a first elongated bar mounted on the mounting part;

an elongated applicator blade carried on the first bar and having an edge riding on the transfer-roll cylindrical surface;

a second movable elongated bar mounted on the mounting part, extending parallel to the first bar, and defining an elongated ink-holding compartment with the first bar;

an elongated applicator blade carried on the second bar, extending parallel to the first-bar blade, and having an edge riding on the cylindrical transfer-roll surface; and guide means supporting the movable bar on the mounting part for movement along an arcuate path having the same radius of curvature as the cylindrical transfer-roll surface between an outer position with the movable-bar blade spaced transversely from the first-bar blade and defining a gap through which ink can flow transversely out of the compartment, and an inner position with the blades engaging one another and closing the gap so that no ink can flow out of the compartment, the movable-bar blade edge remaining in contact with the cylindrical transfer-roll surface at all times.

2. The ink applicator defined in claim 1 wherein the first bar is fixed on the mounting part.

3. The ink applicator defined in claim 1 wherein the means includes guide formations constraining the movable bar and its blade to translatory movement transversely relative to the first bar between its inner and outer positions.

4. The ink applicator defined in claim 1, further comprising latch means for locking the movable bar releasably in each of its positions.

5. In combination with a transfer roll having a cylindrical surface, an ink applicator comprising:

at least one generally stationary mounting part;

a first elongated bar mounted on the mounting part;

an elongated applicator blade carried on the first bar and having an edge riding on the cylindrical transfer-roll surface;

a second movable elongated bar mounted on the mounting part, extending parallel to the first bar, and defining an elongated ink-holding compartment with the first bar;

an elongated applicator blade carried on the second movable bar, extending parallel to the first-bar blade, and having an edge riding on the cylindrical transfer-roll surface; and guide means supporting the movable bar on the mounting part for movement along an arcuate path having the same radius of curvature as the cylindrical transfer-roll surface between an outer position with the movable-bar blade spaced transversely from the first-bar blade and defining a gap through which ink can flow out of the compartment, and an inner position with the blades engaging one another and closing the gap so that no ink can flow out of the compartment, the guide means including an axially projecting pin and a transversely elongated arcuate slot in which the pin can slide constraining the movable bar and its blade to movement transversely relative to the first bar between its inner and outer positions, the movable-bar blade edge remaining in contact with the cylindrical transfer-roll surface at all times.

6. The ink applicator defined in claim 5 wherein the slot is formed in the mounting part and the pin is fixed in the movable bar.

7. The ink applicator defined in claim 6 wherein the mounting part has two longitudinally opposite ends each formed with one such slot, the movable bar being provided with two such pins riding in the slots.

8. The ink applicator defined in claim 7, further comprising a seal engaging both blades at the ends and preventing leakage from the compartment out the gap adjacent the ends in both positions of the movable bar.

9. The ink applicator defined in claim 8 wherein the seal has a lip bearing on back faces of both blades.

10. In combination with a transfer roll having a cylindrical surface, an ink applicator comprising:

at least one generally stationary mounting part;

a first elongated bar mounted on the mounting part;

an elongated applicator blade carried on the first bar and having an edge riding on the cylindrical transfer-roll surface;

a second movable elongated bar mounted on the mounting part, extending parallel to the first bar, and defining an elongated ink-holding compartment with the first bar;

an elongated applicator blade carried on the second movable bar, extending parallel to the first-bar blade, and having an edge riding on the cylindrical transfer-roll surface;

guide means supporting the movable bar on the mounting part for movement along an arcuate path having the same radius of curvature as the cylindrical transfer-roll surface between an outer position with the movable-bar blade spaced transversely from the first-bar blade and defining a gap through which ink can flow out of the compartment, and an inner position with the blades engaging one another and closing the gap so that no ink can flow out of the compartment, the movable-bar blade edge remaining in contact with the cylindrical transfer-roll surface at all times; and latch means for locking the movable bar releasably in each of its positions, the latch means including a longitudinally retractile pin and a stop plate having a pair of holes in each of which the pin is engageable in a respective one of the positions of the movable bar.

11. The ink applicator defined in claim 10 wherein the pin is on the movable bar and the stop plate is on the mounting part.

12. The ink applicator defined in claim 11 wherein the mounting part has two longitudinally opposite end parts each provided with one such stop plate, and the movable bar is provided with two such pins.

* * * * *